US009717286B1

(12) United States Patent
Lee

(10) Patent No.: US 9,717,286 B1
(45) Date of Patent: Aug. 1, 2017

(54) SUPPORT STRUCTURE OF BRA CUP

(71) Applicant: DOMOHO BEST TEXTILE CO., LTD., Taichung (TW)

(72) Inventor: Chen-Chiang Lee, Taipei (TW)

(73) Assignee: Domoho Best Textile Co., Ltd., Taichung (TW)

( * ) Notice: Subject to any disclaimer, the term of this patent is extended or adjusted under 35 U.S.C. 154(b) by 0 days.

(21) Appl. No.: 15/278,256

(22) Filed: Sep. 28, 2016

(51) Int. Cl.
*A41C 3/12* (2006.01)

(52) U.S. Cl.
CPC ..... *A41C 3/122* (2013.01)

(58) Field of Classification Search
CPC .... A41C 1/00; A41C 1/16; A41C 3/00; A41C 3/0007; A41C 3/0014; A41C 3/12; A41C 3/122; A41C 3/128
USPC ..... 450/41, 43, 49, 45, 47, 48, 51, 52
See application file for complete search history.

(56) References Cited

U.S. PATENT DOCUMENTS 3,704,713 A * 12/1972 Hopper ..... A41C 3/0007 450/52
8,317,568 B2 * 11/2012 He ..... A41C 3/128 450/41
2008/0076326 A1 * 3/2008 Wan ..... A41C 3/142 450/41
2011/0237158 A1 * 9/2011 He ..... A41C 3/0007 450/43
2012/0302134 A1 * 11/2012 Wan ..... A41C 5/00 450/41
2014/0057529 A1 * 2/2014 Wan ..... A41C 3/14 450/41

* cited by examiner

*Primary Examiner* — Gloria Hale
(74) *Attorney, Agent, or Firm* — Alan D. Kamrath; Kamrath IP Lawfirm, P.A.

(57) ABSTRACT

A support structure of a bra cup contains: a bra cup body and an underwire channel. The bra cup body includes a concave face and a convex face, and the concave face has an imaginary point defined on a central position thereof. The underwire channel is hollow and is in an arcuate strap shape, and the underwire channel is mounted on a peripheral side of a bottom of the bra cup body. The underwire channel includes an external layer, an internal layer, and a hollow portion. The hollow portion has an opening arranged on one end thereof and configured to accommodate an underwire. The underwire channel further includes a flexible mesh sheet arranged on one surface thereof facing the bra cup body. The flexible mesh sheet has a reinforcement section extending outwardly from the underwire channel to the imaginary point of the concave face of the bra cup body.

4 Claims, 9 Drawing Sheets

SUPPORT STRUCTURE OF BRA CUP

BACKGROUND OF THE INVENTION

Field of the Invention

The present invention relates to a bra cup and, more particularly, to a support structure of the bra cup which supports and lifts each of the user's breasts firmly.

Description of the Prior Art

A conventional brassiere is made of fabric material and contains two bra cups made of foam or cotton to cover the user's breasts. Each of the two bra cups is thermoplastic molded to correspond to and to support each of the user's breasts. Alternatively, the brassiere is thermoplastic molded from foam or cotton to support and lift each breast. Furthermore, an underwire is accommodated in a bottom of each bra cup and is made of metal material, but when the underwire is made of metal material, it will cause inconvenience in customs inspection. To overcome the aforesaid problem, the underwire is made of the plastic material, but it cannot support each breast completely.

Referring to FIGS. 8 and 9, a conventional support structure of a bra cup contains a body 80 corresponding to a profile of a breast, and the body 80 includes an underwire channel 81 defined on a peripheral side of a bottom thereof and having an opening 811. An underwire 90 is housed in and is removed from the opening 811 of the underwire channel 81. Hence, the underwire 90 is removed from the opening 811 in the custom inspection, i.e., the underwire 90 is replaceable and is made of the metal material or the plastic material based on using requirements.

However, when wearing the brassiere, the underwire 90 in the underwire channel 81 of the body 80 can only support a bottom of the breast instead of the entire breast.

The present invention has arisen to mitigate and/or obviate the afore-described disadvantages.

SUMMARY OF THE INVENTION

The primary objective of the present invention is to provide a support structure of a bra cup in which an underwire is made of metal material or plastic material based on using requirements.

Another objective of the present invention is to provide a support structure of a bra cup in which an underwire channel further includes a flexible mesh sheet arranged on one surface thereof facing a bra cup body, and the flexible mesh sheet has an arcuate reinforcement section extending outwardly from the underwire channel to an imaginary point of a concave face of the bra cup body to support and lift each of the user's breasts by mating with the underwire channel and the underwire.

A support structure of a bra cup provided by the present invention contains: a bra cup body and an underwire channel.

The bra cup body includes a concave face and a convex face, and the concave face has an imaginary point defined on a central position thereof. The underwire channel is hollow and is in an arcuate strap shape, and the underwire channel is mounted on a peripheral side of a bottom of the bra cup body. The underwire channel includes an external layer, an internal layer, and a hollow portion. The hollow portion has an opening arranged on one end thereof and configured to accommodate an underwire, and the underwire channel further includes a flexible mesh sheet arranged on one surface thereof facing the bra cup body. The flexible mesh sheet has a reinforcement section extending outwardly from the underwire channel to the imaginary point of the concave face of the bra cup body.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
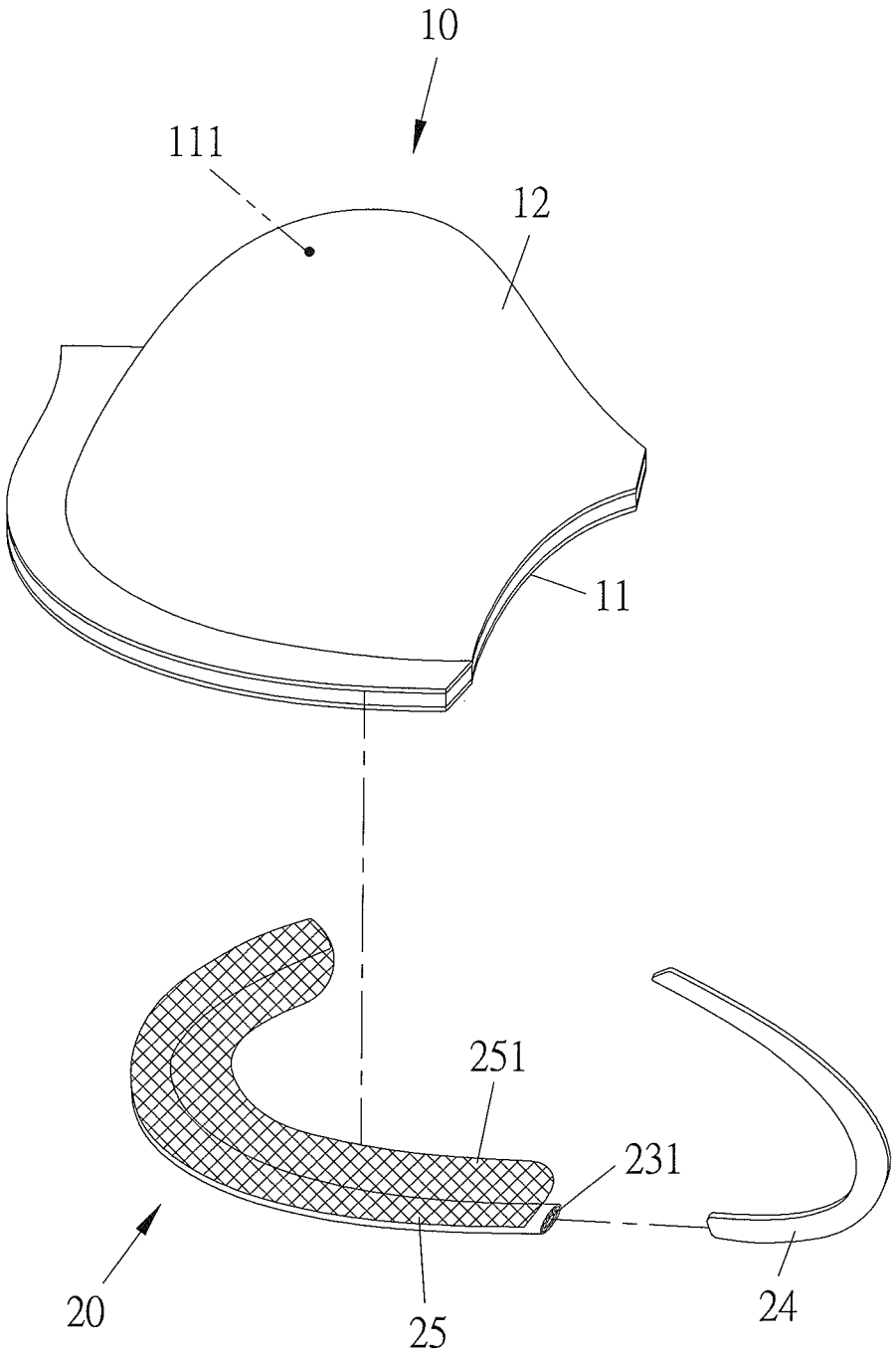
FIG. 1 is a perspective view showing the exploded components of a support structure of a bra cup in accordance with a first embodiment of the present invention.
Figure 2:
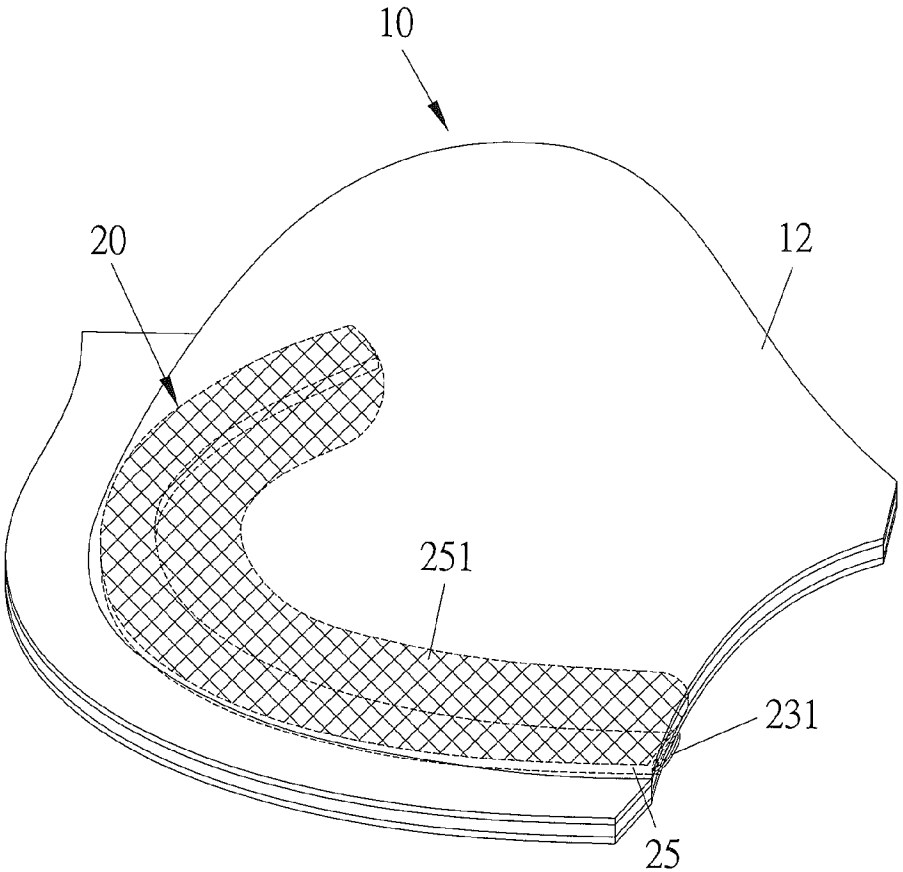
FIG. 2 is a perspective view showing the assembly of the support structure of the bra cup in accordance with the first embodiment of the present invention.
Figure 3:
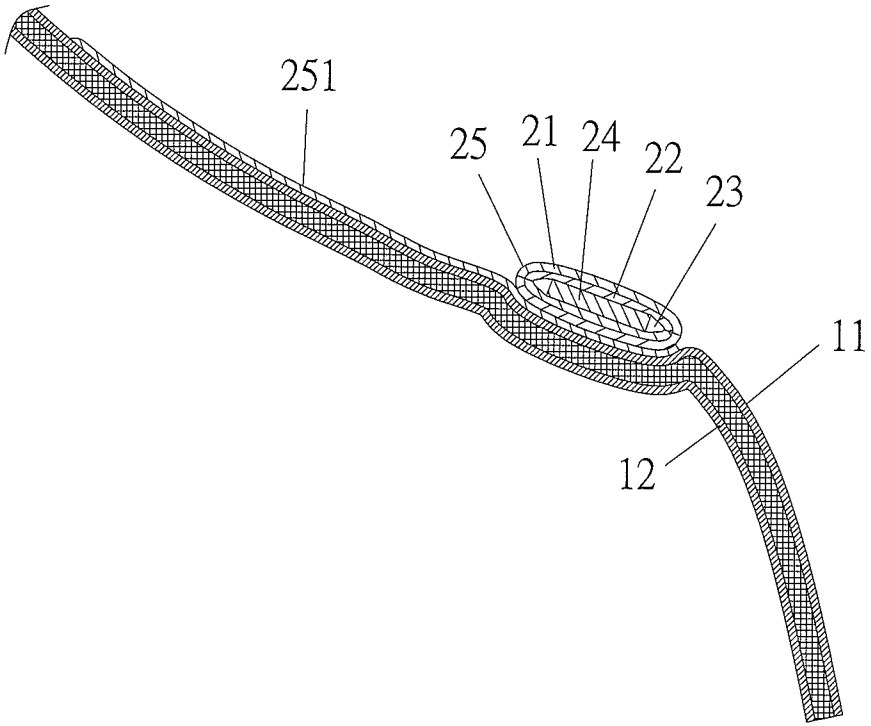
FIG. 3 is a cross sectional view showing the assembly of the support structure of the bra cup in accordance with the first embodiment of the present invention.

Referring to FIGS. 1-3, a support structure of a bra cup according to a first embodiment of the present invention comprises a bra cup body 10 and an underwire channel 20.

The bra cup body 10 includes a concave face 11 and a convex face 12, and the concave face 11 has an imaginary point 111 defined on a central position thereof.

The underwire channel 20 is hollow and is in an arcuate strap shape. The underwire channel 20 is mounted on the concave face 11 of a bottom of the bra cup body 10 and includes an external layer 21, an internal layer 22, and a hollow portion 23. The external layer 21 and the internal layer 22 are made of fabric material, and the hollow portion 23 has an opening 231 arranged on one end thereof and configured to accommodate an underwire 24. The underwire 24 is made of metal material or plastic material. A depth of the hollow portion 23 of the underwire channel 20 is more than a length of the underwire 24, such that the underwire 24 is inserted into the hollow portion 23. The underwire channel 20 further includes a flexible mesh sheet 25 arranged on one surface thereof facing the bra cup body 10, and a part of the flexible mesh sheet 25 is defined between the underwire channel 20 and the bra cup body 10. The flexible mesh sheet 25 has an arcuate reinforcement section 251 extending outwardly from the underwire channel 20 to the imaginary point 111 of the concave face 11 of the bra cup body 10.

Figure 4:
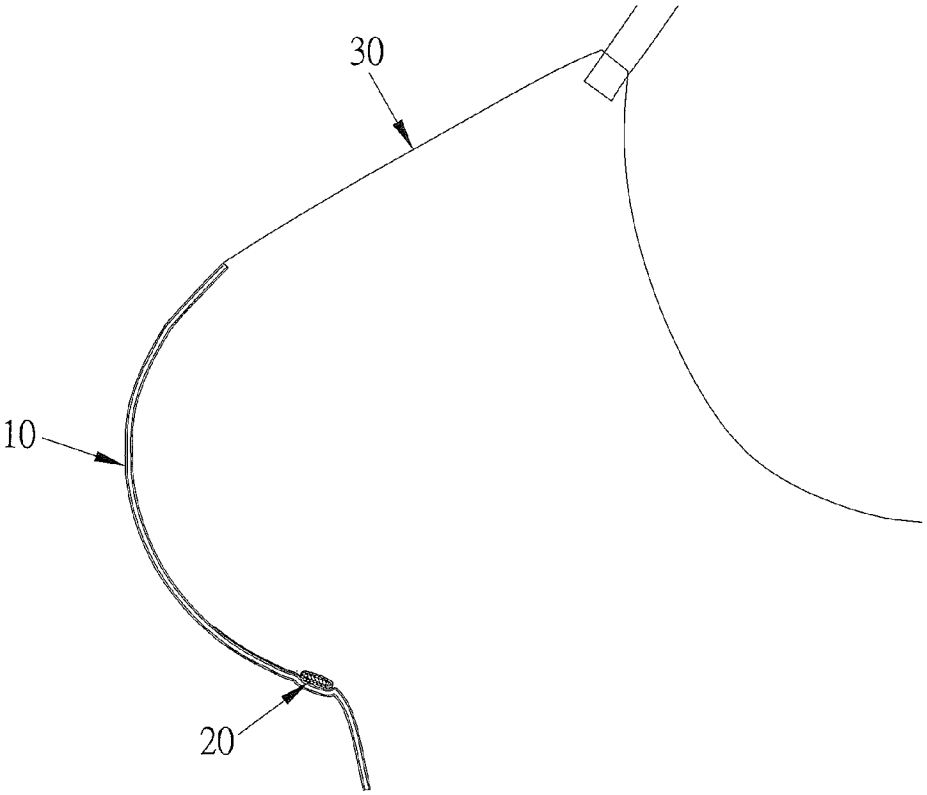
FIG. 4 is a side plane view showing the application of the support structure of the bra cup in accordance with the first embodiment of the present invention.
Figure 5:
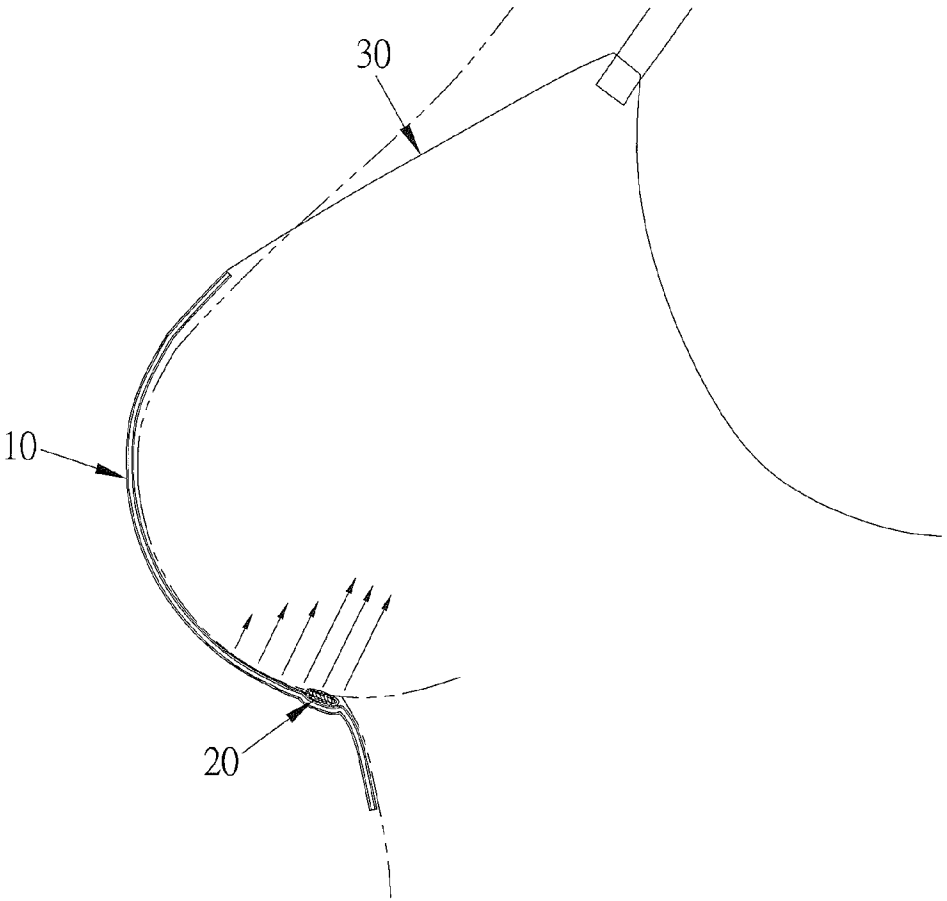
FIG. 5 is another side plane view showing the application of the support structure of the bra cup in accordance with the first embodiment of the present invention.

Referring further to FIGS. 4 and 5, in application, two bra cup bodies 10 and two underwire channels 20 are fixed on a brassiere 30, so that the two bra cup bodies 10 cover the user's breasts. Two underwires 24 in the two underwire channels 20 of the two bra cup bodies 10 support the user's breasts, and the two arcuate reinforcement sections 251 of the two flexible mesh sheets 25 of the two underwire channels 20 lift and support the user's breasts firmly. Preferably, the two flexible mesh sheets 25 enhance air permeability of the two bra cup bodies 10.

Figure 6:
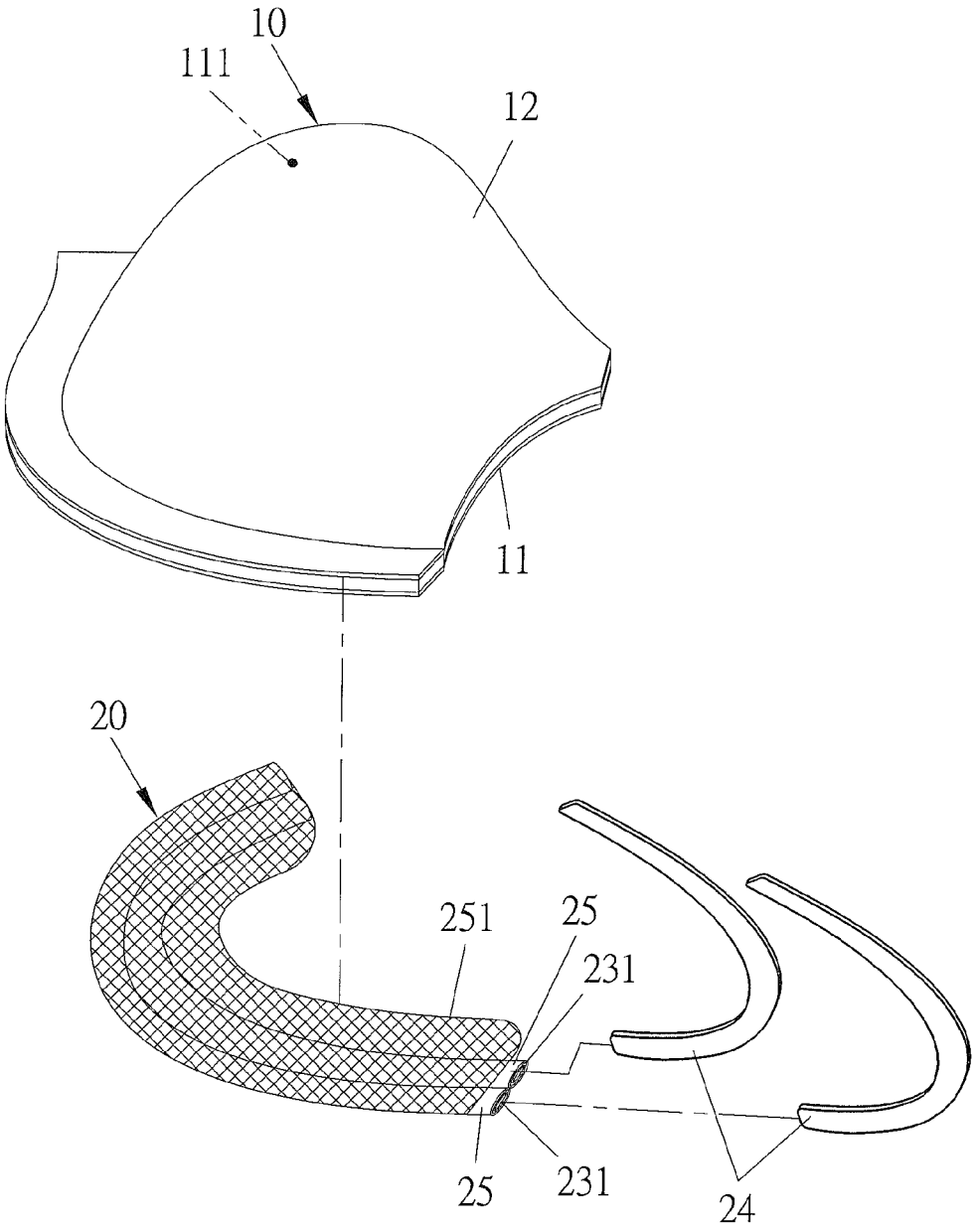
FIG. 6 is a perspective view showing the exploded components of a support structure of a bra cup in accordance with a second embodiment of the present invention.
Figure 7:
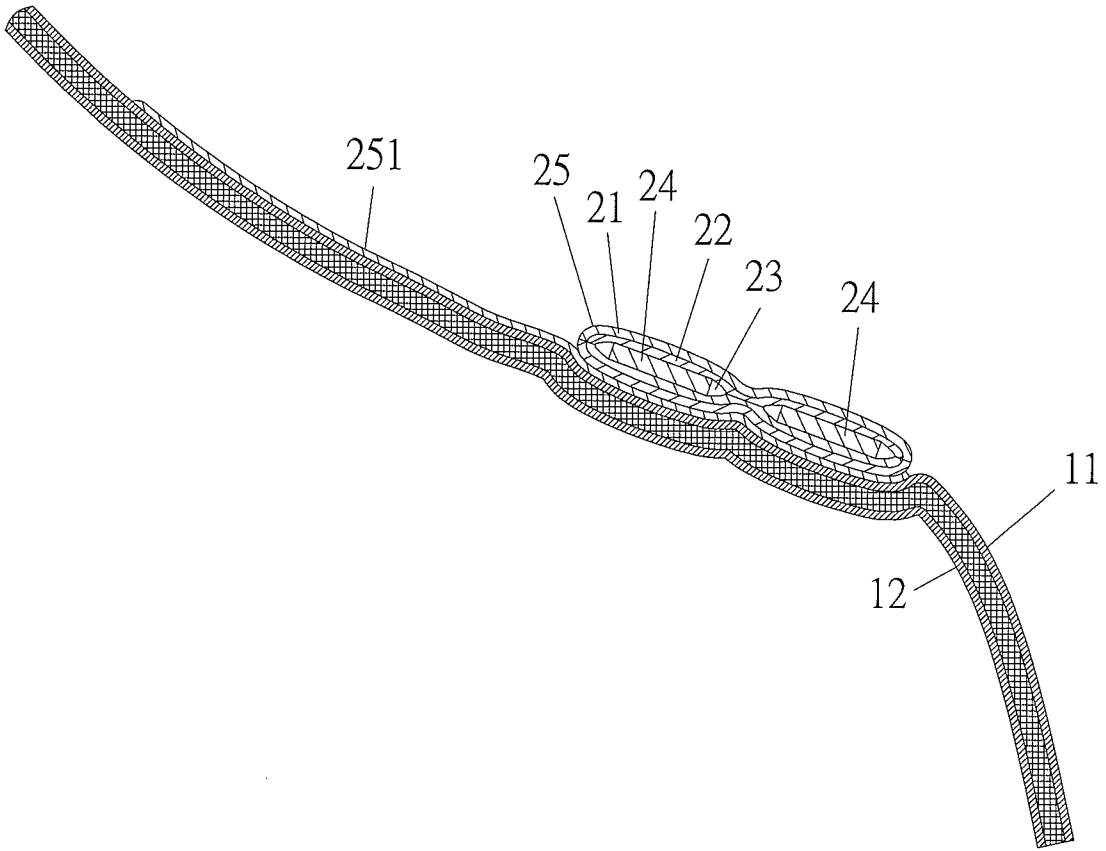
FIG. 7 is a cross sectional view showing the assembly of the support structure of the bra cup in accordance with the second embodiment of the present invention.
Figure 8:
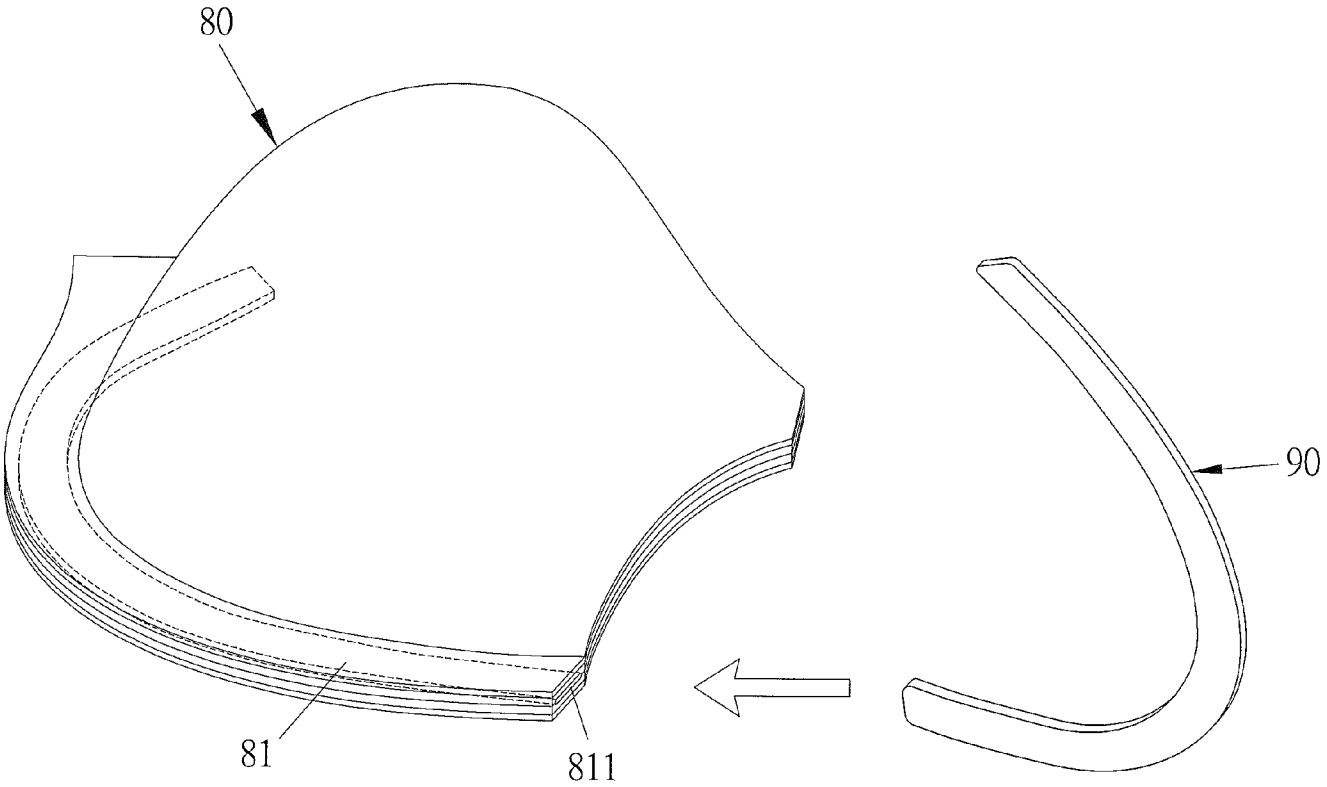
FIG. 8 Prior Art
FIG. 8 is a perspective view showing the exploded components of a conventional support structure of a bra cup.
Figure 9:
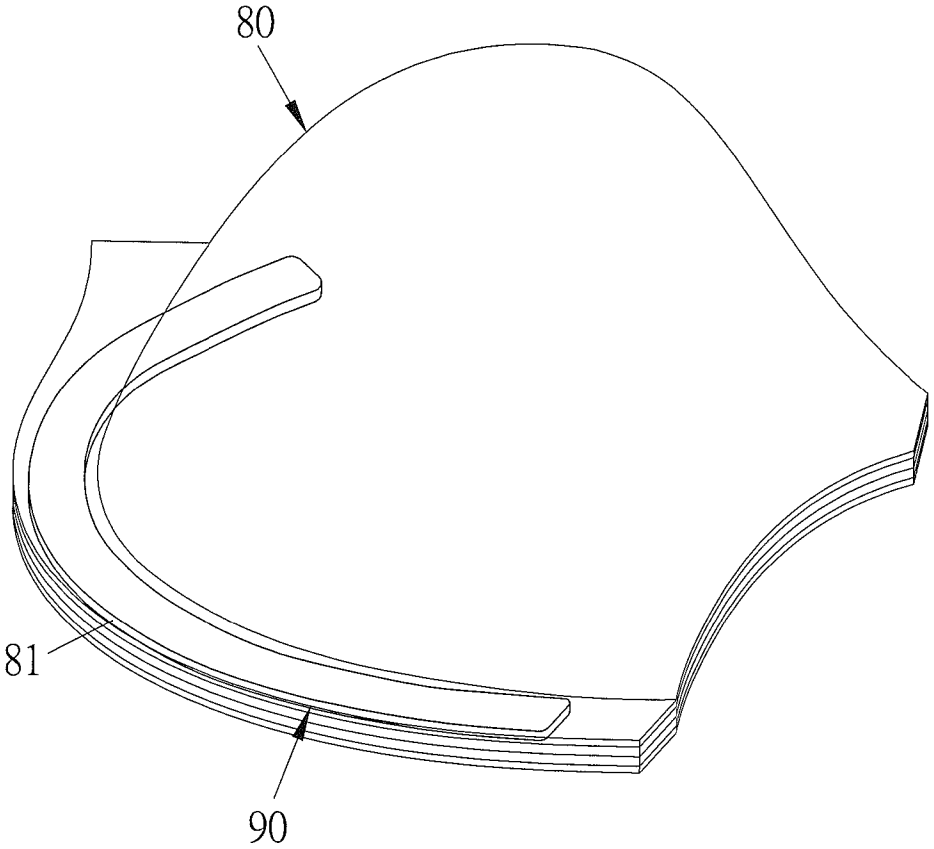
FIG. 9 Prior Art
FIG. 9 is a perspective view showing the assembly of the conventional support structure of the bra cup.

As shown in FIGS. 6 and 7, in a second embodiment, two hollow portions 23 are defined on an underwire channel 20. The two hollow portions 23 accommodate two underwires 24, respectively, thus enhancing support capacity by using the two underwires 24.

Accordingly, the underwire 24 of the support structure of the bra cup is made of metal material or plastic material based on using requirements. In addition, the underwire channel 20 further includes the flexible mesh sheet 25 arranged on the one surface thereof facing the bra cup body 10, and the flexible mesh sheet 25 has the arcuate reinforcement section 251 extending outwardly from the underwire channel 20 to the imaginary point 111 of the concave face 11 of the bra cup body 10 to support and lift each of the user's breasts by mating with the underwire channel 20 and the underwire 24.

While various embodiments in accordance with the present invention have been shown and described, it is clear to those skilled in the art that further embodiments may be made without departing from the scope of the present invention.

What is claimed is:

1. A support structure of a bra cup comprising:

a bra cup body including a concave face and a convex face, with the concave face having an imaginary point defined on a central position thereof; and an underwire channel being hollow and in an arcuate strap shape, with the underwire channel mounted on a periphery of a bottom of the bra cup body, with the underwire channel including an external layer, an internal layer, and a hollow portion, wherein the hollow portion has an opening arranged on one end thereof and configured to accommodate an underwire, wherein the underwire channel further includes a flexible mesh sheet arranged on one surface thereof facing the bra cup body, wherein the flexible mesh sheet has a reinforcement section extending from the underwire channel to the imaginary point of the concave face of the bra cup body.

2. The support structure of the bra cup as claimed in claim 1, wherein the underwire is made of metal material or plastic material.

3. The support structure of the bra cup as claimed in claim 1, wherein a depth of the hollow portion of the underwire channel is more than a length of the underwire.

4. The support structure of the bra cup as claimed in claim 1, wherein the reinforcement section is arcuate.

* * * * *